United States Patent [19]

Nagahama et al.

[11] Patent Number: 4,824,271

[45] Date of Patent: Apr. 25, 1989

[54] NIB FOR WRITING INSTRUMENTS

[75] Inventors: Masamitsu Nagahama, Saitama; Masaaki Ohsawa, Ashikaga; Masayuki Kawasaki, Soka, all of Japan

[73] Assignee: Pental Kabushiki Kaisha, Tokyo, Japan

[21] Appl. No.: 640,834

[22] Filed: Aug. 15, 1984

[30] Foreign Application Priority Data

Aug. 31, 1983 [JP] Japan ..... 58-134551

[51] Int. Cl.[4] ..... B43K 1/12; B43K 1/04; B43K 8/02

[52] U.S. Cl. ..... 401/196; 401/199; 401/261; 401/266

[58] Field of Search ..... 401/264, 266, 261, 267, 401/263, 196, 199

[56] References Cited

U.S. PATENT DOCUMENTS

| | | | |
|---|---|---|---|
| 933,938 | 9/1909 | Windle et al. | 401/264 |
| 1,333,034 | 3/1920 | Nawn | 401/267 X |
| 1,968,062 | 7/1934 | Wood | 401/261 |
| 2,049,973 | 8/1936 | Nesmith | 401/261 |
| 4,208,145 | 6/1980 | Azuma | 401/196 |

*Primary Examiner*—Steven A. Bratlie

*Attorney, Agent, or Firm*—Wenderoth, Lind & Ponack

[57] ABSTRACT

A planar or plate-like nib for writing instruments has a plurality of separate ink feeding channels which are distributed in the widthwise direction of the planar nib, and a split at the end portion along the entire width thereof. The split provides a suitable flexibility to the nib and desirable writing with a predetermined thickness with clear marginal ends of written lines. Further, the split connects the separate channels with one another at the writing end portion of the nib so that a uniform flow of ink to the writing end portion of the nib is achieved.

3 Claims, 3 Drawing Sheets

NIB FOR WRITING INSTRUMENTS

BACKGROUND OF THE INVENTION

The present invention relates in general to a stylus or nib for writing instruments and more particularly to a synthetic resin or metal nib of a planar, or plate-like type which is desirable and beneficial for writing thick lines.

A typical writing instrument of this type is a so-called felt pen which has a writing nib formed of a multiplicity of fibers or filaments having a wedge-shaped or chisel-shaped end. Another typical instrument of similar type is a fountain pen having a relatively wide end for writing thick lines.

The writing nib of a bundle of fibers or filaments provides a disadvantage such that ends of a line written therewith become unclear and obscure due to discrete arrangement or movement of each fiber or filament. The nib of a fountain pen as described above makes it difficult to obtain a written line of predetermined width because of a slit provided at its end for ink feeding action. Namely, in order to provide a written line of a definite width, the writing pressure applied to the writing nib must be maintained constant.

When a thick written line is to be obtained, a sufficiently large ink feed channel must be formed to provide a favorable discharge of ink. However, if the writing nib is formed thicker so as to satisfy the requirement of ink-discharge, the nib becomes substantially rigid, resulting in difficulty in providing uniform contact of the nib with respect to a writing surface such as a sheet of paper. If the writing nib is formed very thin so as to provide desirable flexibility, a sufficiently large ink channel will not be obtained.

It is possible to eliminate, to a limited extent, the foregoing problems by, for example, selectively employing the most desirable materials for the nib of forming the tip end of the nib in a tapered or inclined configuration. However, in order to provide the writing nib with desirable hardness, and stability and to ensure reliability of a definite width of written lines, it is necessary to employ materials which have a desired hardness, and the selection of materials is limited. Besides, when the nib is cut aslant to form a tapered or inclined end so as to provide flexibility, it is difficult to obtain a desirable angle of inclination. If the angle is very sharp, the same results occur as with a nib of reduced thickness.

SUMMARY OF THE INVENTION

An object of the present invention is to provide a writing nib which can form a written line of predetermined thickness.

Another object of the present invention is to provide a writing nib which exhibits desired resilience.

A further object of the present invention is to provide a writing nib with a sufficient ink feeding channel.

According to the present invention, there is provided a writing nib of a resilient material and comprising a planar end portion, a plurality of separate ink feeding channels distributed in its widthwise direction, and a split provided in the widthwise direction. The split is exposed at the end of the nib, but is not contacted with a writing surface such as a paper, except when the writing nib is used in a substantially vertical position during writing. The split provides the nib with desired resilience and enables uniform contact of the nib with a writing surface.

The writing nib according to the invention can be used for various types of writing instruments such as, for example, a fountain pen and an instrument incorporating a ink reservoir in the form of a bundle of synthetic fibers and the like.

BRIEF DESCRIPTION OF THE DRAWINGS

FIGS. 11 and 12 are side views of the writing nib, wherein FIG. 11 shows a round shaped end and FIG. 12 shows an angular end;

PREFERRED EMBODIMENTS OF THE INVENTION

Figure 1:
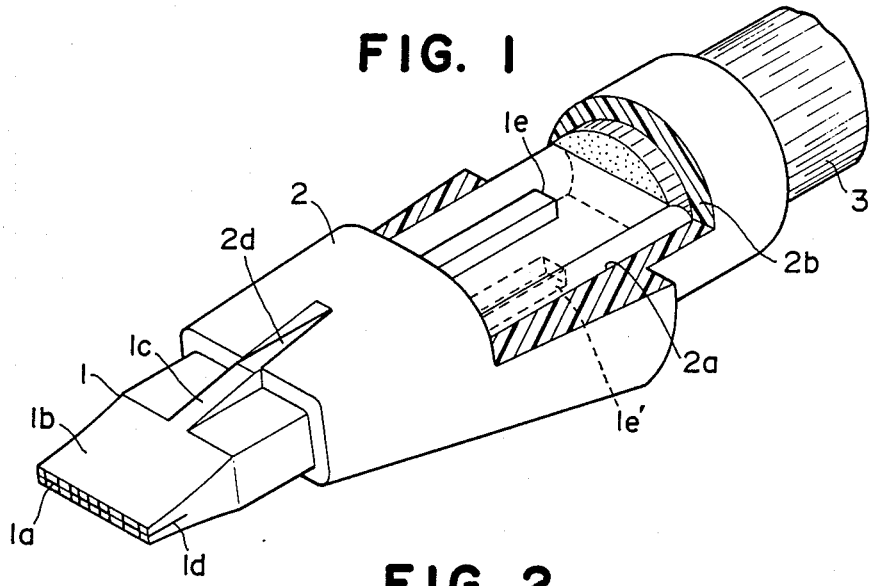
FIG. 1 is a partly cut-away perspective view of a writing nib embodying the invention, showing the nib being mounted to a nib holder.

Referring to FIGS. 1 through 5 showing a first embodiment of the invention, a writing nib 1 has a generally planar, or plate-like shape, and has longitudinally extended ink feed channels 1*a*, a reduced thickness end portion 1*b*, longitudinal projections 1*c*, 1*c*′ at the centers of opposite sides thereof, and a split 1*d* extending longitudinally from the front end toward its rear end. Reference numeral 2 is a nib holder which has a front bore 2*a* for receiving the nib 1 and a rear bore 2*b* for receiving an ink feeding intermediate member 3 such as a fiber bundle or an open-cell foam plastic member. Bore 2*a* of nib holder 2 has a shape, shown particularly in FIG. 3, including recesses 2*c*, 2*c*′ receiving projections 1*c*, 1*c*′, and steps 2*e*, 2*e*′ (see FIG. 2) abutting ends 1*e*, 1*e*′ of projections 1*c*, 1*c*′. Also, cut-outs 2*d*, 2*d*′ in nib holder 2 exposed portions of outer surfaces of projections 1*c*, 1*c*′.

The nib structure will be explained hereinafter. The nib 1, which is made of a material having a suitable flexibility such as synthetic resins such as polyacetal and polyamide or a suitable metal, has separate ink feeding channels 1*a* distributed in the widthwise direction. The separate distribution of the ink feeding channels 1*a* prevents an excessive deformation of the nib and prevents the ink feeding channels from being crushed and jammed when a writing pressure is imparted to the nib. Further, the separate distribution of the ink feeding channels 1*a* enhances capillary action of ink feeding through the channels 1*a*. It is to be noted that the ink feeding channels are preferably formed to be of rather complex transverse cross sectional shape for the purpose of prevention of ink retreat or back flow into the reservoir, although this partly depends upon other factors such as the materials of the nib and ink-wetting characteristics.

Figure 6:
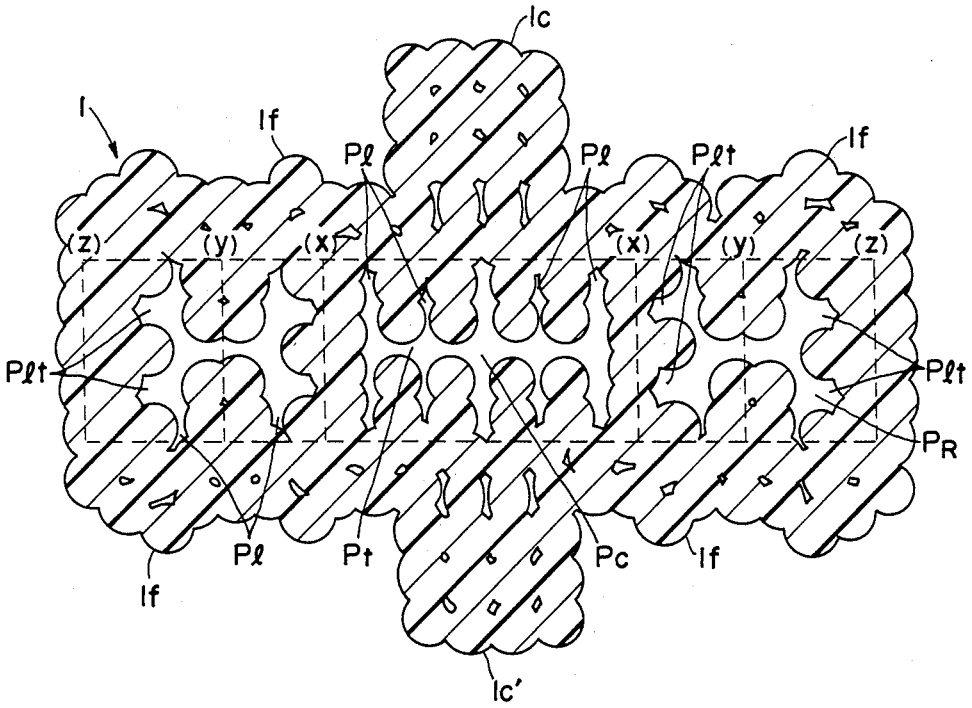
FIG. 6 is an enlarged cross sectional view of the writing nib, showing an example of a desired pattern of ink feeding channels.

A suitable pattern of the ink feeding channels is shown in FIG. 6. The writing nib 1 shown in FIG. 6, which can be formed by an extrusion method wherein synthetic resin monofilaments are adhered has three divided or separate ink feeding channels. In FIGS. 1–10, the ink feeding channels are represented by reference characters $P_C$, $P_R$ and $P_L$, wherein $P_C$ represents a central channel, $P_R$ represents a right-hand side channel, and $P_L$ represents a left-hand side channel. The ink feeding channels $P_C$, $P_R$, $P_L$ are each formed as a combined structure of a channel element Pl in a warp (i.e. substantially vertical) direction and a channel element Pt in a lateral direction. The channel element Pt of the ink feeding channel $P_C$ is formed longer than the channel elements Pt of the ink feeding channels $P_R$ and $P_L$, and a locational interval or distance between the channel elements Pl of the ink feeding channels $P_R$ and $P_L$ is larger than the distance between the channel elements Pl of the ink feeding channel $P_C$. Reference character Plt represents extended channel portions of the channel elements Pl of the ink feeding channels $P_R$ and $P_L$, the extended channel portions Plt extending in the lateral direction as illustrated.

Figure 7:
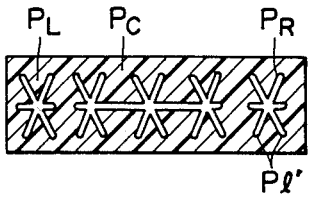
FIGS. 7 through 10 are cross sectional views of the nib, showing schematically other patterns of ink feeding channels.
Figure 8:
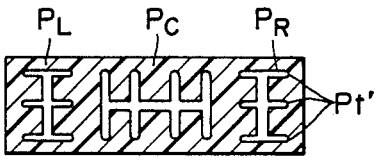
Figure 9:
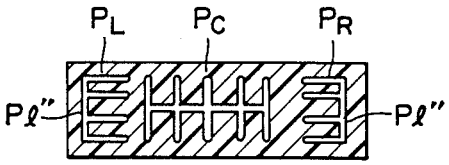
Figure 10:
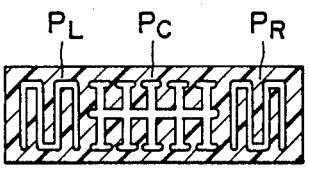

Referring to FIGS. 7 through 10 showing diagrammatically other desired patterns of the ink feeding channels. FIG. 7 shows a pattern in which channel elements Pl′, each of which corresponds to a channel element Pl in the pattern of FIG. 6, ae formed in a crossing configuration. FIG. 8 shows a pattern having a plurality of channel elements Pt′ which correspond to the channel elements Pt of the channels $P_R$ and $P_L$ in FIG. 6. FIG. 9 shows a pattern in which channel element Pl″ corresponding to the elements Pl of channels $P_R$ and $P_L$ of FIG. 6 are provided at the outermost portions of the respective channels. FIG. 10 shows a further modified pattern showing the right and left side ink channels $P_R$, $P_L$ formed in a zig-zag configuration as illustrated.

In all the patterns illustrated in FIGS. 6 through 10, the ink feeding channels are each constructed with, in combination, at least one warp or vertical channel element and at least one lateral channel element. This structure of the ink feeding channels can maintain reliable ink feeding action without jamming or plugging the channels and can prevent ink which is located within the channels of the nib from retreating into the reservoir.

Figure 2:
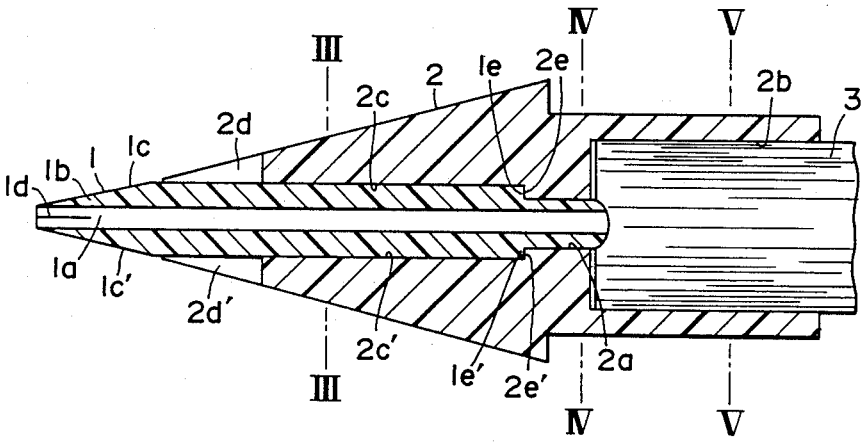
FIG. 2 is a longitudinal sectional view of the writing nib illustrated in FIG. 1.
Figure 3:
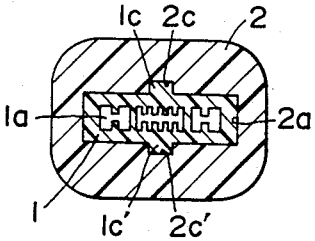
FIG. 3 is a transverse sectional view of a writing tip portion including the nib, taken along line III—III in FIG. 2.
Figure 4:
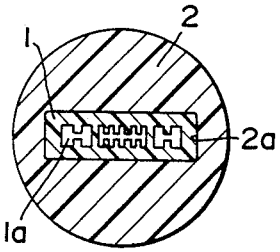
FIG. 4 is a transverse sectional view of the writing tip portion, taken along line IV—IV in FIG. 2.
Figure 5:
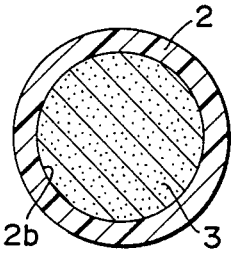
FIG. 5 is a transverse sectional view of the writing tip portion, taken along line V—V in FIG. 2.

Again with reference to FIG. 6, reference numeral 1*f* represents projections formed on the outer surface of the writing nib 1 for enhancing a reliable press-fit engagement between the nib 1 and the nib holder 2 (FIGS. 1 and 2). The thus formed writing nib 1 can be cut or abraded to form a nib end portion of dimensions (x)−(x), (y)−(y) or (z)−(z). Namely, the phantom lines in FIG. 6 as well as the reference characters (x), (y) and (z) show examples of ends of the nib 1 which may be formed from the nib material. As previously described, the distance between the channel elements Pl of the ink feeding channels $P_R$ and $P_L$ is formed larger than those of the central channel $P_C$, thereby to enhance an accurate and reliable formation of the nib to the (y)−(y) structure.

Figure 11:
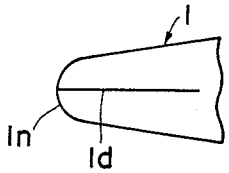
Figure 12:
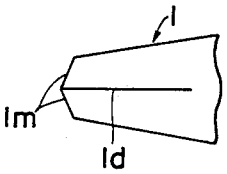

FIGS. 11 and 12 show preferred forms of the nib and wherein FIG. 11 shows a round shaped nib end 1*n* and FIG. 12 shows an angled nib end having two flat ends 1*m*. These nib ends 1*n*, 1*m* will provide smooth and reliable writing rather than the structure in which all the ink feeding channels are disposed within end portion, since writing is generally conducted with the instrument being inclined relative to the writing surface. Further, the nib end structure of FIGS. 11 and 12 can maintain the desirable flexibility.

Figure 13:
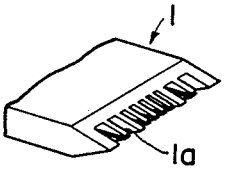
FIG. 13 is a perspective view of a rear end portion of the writing nib, the rear end portion being adapted to engage with an ink feed mechanism or reservoir.

FIG. 13 shows a preferable structure of the rear end of writig nib 1. As illustrated, the nib 1 is cut aslant or tapered so that the tapered end is inserted into the ink feeding intermediate member 3 (FIGS. 1 and 2) so as to enhance a smooth and continuing ink feeding action from the intermediate members 3 to the nib 1.

Figure 14:
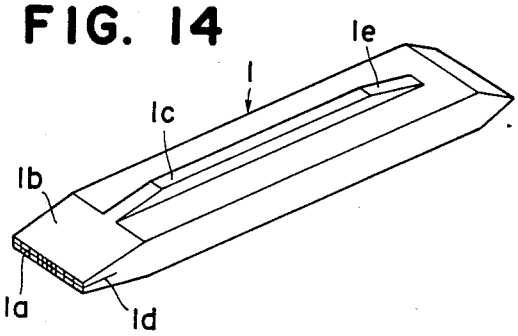
FIGS. 14 and 15 are perspective views of the writing nib, showing examples of the entire structure for press-fit mounting of the nib to a nib holder.
Figure 15:
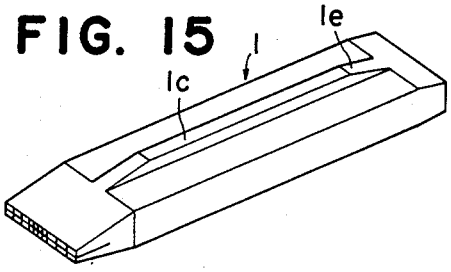

FIGS. 14 and 15 show modified structure of the writing nib shown in FIGS. 1 and 2. In the modified structure of FIGS. 14 and 15, the rear end portions 1*e*, 1*e*′ of the longitudinal projections 1*c*, 1*c*′ are cut aslant or tapered so that a reliable engagement can be made between the writing nib and the nib holder 2. According to the invention the plane-shaped nib can be obtained in such a manner that a columnar or solid-cylindrical nib body is prepared and then formed into the predetermined planar structure. Further, the ink feeding channels can be divided into more than three sections, although the patterns shown in FIGS. 6 through 10 provide only three divided channels.

Formation of the split 1*d* will be explained. The split 1*d* can be formed by known suitable methods and tools, for example by means of a razor-like tool. Alternatively, the split ca be formed such that an area of reduced adhesion is formed at the position where the split is to be formed and then an external pressure is added to such area to release the adhesion. If desired, a pair of nib halves are prepared and then adhered to each other except for the portion where the split is to be formed. Thus, as will be apparent from the above description and from a consideration of the drawings, the split 1*d* interrupts the structural integrity of the nib material without the formation of a space or gap between the opposed nib material surfaces defining the split. In other words, such surfaces are in direct contact. The depth of the split toward the rear end of the nib 1 is determined based upon the width of the nib, and so forth. For example, four writing nibs with the same thickness of 0.5 mm at the front end thereof have width of 0.5 mm, 1.0 mm, 1.5 mm and 2.0 mm. These four nibs were formed from polyacetal nib material, each having a thickness of about 1 mm and a width of about 2.5 mm. Experiments were made by providing splits of 0.7 mm, 1.0 mm, 1.5 mm, 2.5 mm and 4.0 mm in depth of each of the nibs. The experiments showed that splits of 0.7–1.0 mm in depth were desired for the nibs with a width of 0.5 mm at the front end thereof. Splits of 0.7–1.5 mm in depth were desirable for the nib-end width of 1.0 mm, and splits of 0.7–2.5 mm in depth were desirable for the nib-end width of 1.5 mm. Similarly, it was found that splits of 0.7–4.0 mm in depth were desirable for the nib which has a nib-end width of 2.0 mm. It will be understood from the experiments that when the width of the nib 1 becomes larger, the depth range of the split 1*d* becomes greater.

Figure 16:
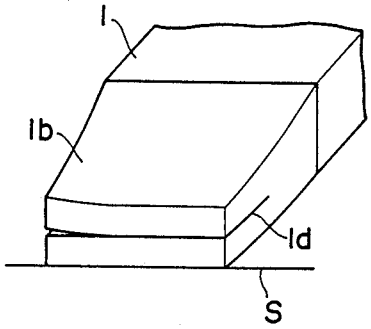
FIG. 16 is an explanatory view of the writing nib according to the invention, showing uniform contact thereof with a writing surface.
Figure 17:
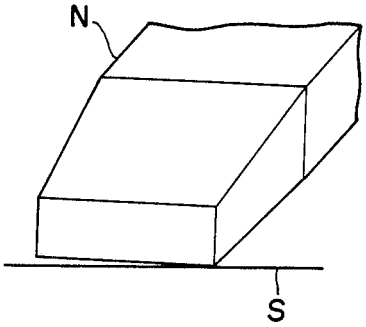
FIG. 17 is an explanatory view of a conventional, known nib, showing nonuniform contact thereof with a writing surface.

Advantages of providing the split 1*d* will be explained with reference to FIGS. 16 and 17, wherein FIG. 17 shows a conventional writing nib N without a split. First, as shown in FIG. 17, it is likely that one end of the nib is spaced from a writing surface S due to nonuniform pressure applied to the entire end portion of the nib. Actually it is found that it is rather difficult to apply a uniform pressure to the entire end portion of the nib during a writing operation. It will be readily anticipated that if either one end portion is spaced, though very slightly, from the writing surface, a desired writing of predetermined thickness will not be expected and the written lines will become partly thinned and unclear. In order to attain uniform contact of the nib to a writing surface, an attempt may be made to form the nib thinner, but this attempt provides additional disadvantges with respect to the ink feeding operation as discussed heretofore.

FIG. 16 shows the writing nib with a split 1*d* according to the present invention. The split 1*d* can provide suitable flexibility to the end portion of the nib, while the ink feeding channels can be made sufficiently large for a suitable ink feeding action. Accordingly, a desired writing with clear margins or ends of written lines can be achieved. Further, the split 1*d* can connect, at the writing point end of the nib the three separate ink feeding channels, so as to provide a uniform provision of ink at the writing point end of the nib.

Although the present invention has been described with reference to the preferred embodiments, many modifications and alterations can be made within the spirit of the invention.

What is claimed is:

1. A nib for a writing instrument, said nib comprising:

an elongated member having a greater width than height and a writing tip end portion;

a plurality of separate ink feeding channels extending throughout the entire length of said member and opening at said tip end portion, said channels being laterally spaced from each other across said width of said member; and a split formed in said tip end portion of said member, said split extending across the entire said width of said member and communicating all of said channels with one another, and said split being defined by opposed contacting surfaces without a space therebetween.

2. A nib as claimed in claim 1, wherein said tip end portion is reduced.

3. A nib as claimed in claim 1, wherein said tip end portion is defined by two flat angular surfaces.

* * * * *